US009834958B2

(12) United States Patent
Tirkkonen et al.

(10) Patent No.: US 9,834,958 B2
(45) Date of Patent: Dec. 5, 2017

(54) PADLOCK

(71) Applicant: Abloy Oy, Joensuu (FI)

(72) Inventors: Jouni Tirkkonen, Joensuu (FI); Pauli Havukainen, Ylamylly (FI)

(73) Assignee: ABLOY OY, Joensuu (FI)

( * ) Notice: Subject to any disclaimer, the term of this patent is extended or adjusted under 35 U.S.C. 154(b) by 0 days.

(21) Appl. No.: 15/322,354

(22) PCT Filed: Jun. 23, 2015

(86) PCT No.: PCT/FI2015/050461

§ 371 (c)(1),
(2) Date: Dec. 27, 2016

(87) PCT Pub. No.: WO2015/197916

PCT Pub. Date: Dec. 30, 2015

(65) Prior Publication Data

US 2017/0138088 A1 May 18, 2017

(30) Foreign Application Priority Data

Jun. 27, 2014 (FI) ..... 20145621

(51) Int. Cl.
*E05B 19/00* (2006.01)
*E05B 67/00* (2006.01)
*E05B 67/02* (2006.01)

(52) U.S. Cl.
CPC ..... *E05B 19/0005* (2013.01); *E05B 67/00* (2013.01); *E05B 67/02* (2013.01)

(58) Field of Classification Search
CPC ..... E05B 37/025; E05B 19/0005; E05B 67/02
USPC ..... 70/20, 408, 396, 397
See application file for complete search history.

(56) References Cited

U.S. PATENT DOCUMENTS 3,621,690 A * 11/1971 Whitcomb ..... A45C 11/321 24/303
3,712,091 A 1/1973 Parent
4,317,344 A * 3/1982 Barnard ..... E05B 17/002 70/55
4,637,238 A * 1/1987 Uda ..... E05B 19/043 70/408
5,051,724 A 9/1991 Morrow et al.
5,086,632 A * 2/1992 Hsu ..... E05B 35/002 70/375
5,440,909 A * 8/1995 Ely ..... E05B 19/00 70/395
6,460,386 B1 * 10/2002 Watanuki ..... B60R 25/04 70/408

(Continued)

FOREIGN PATENT DOCUMENTS

JP 2001-012121 A 1/2001

*Primary Examiner* — Suzanne Barrett
(74) *Attorney, Agent, or Firm* — Muncy, Geissler, Olds & Lowe, P.C.

(57) ABSTRACT

A padlock having a key intended to unlock another lock. The other lock can be a padlock or some other locking structure. The key is inserted into a bore made in the body of the padlock, intended for one end of the shackle. To fit the key into the bore, its blade section is pivotable relative the shank of the key, and the blade section is adapted, in a first position of the blade section, to be at least partially received into the bore. The shank of the key can be received into the bore as well.

7 Claims, 3 Drawing Sheets

(56) References Cited

U.S. PATENT DOCUMENTS

| | | | | |
|---|---|---|---|---|
| 6,536,246 | B2 * | 3/2003 | Wilson | B62H 5/003 70/233 |
| 7,171,830 | B2 * | 2/2007 | Taljaard | E05B 39/02 70/422 |
| 7,310,980 | B2 * | 12/2007 | Hashimoto | A45C 11/32 70/252 |
| 7,426,841 | B2 * | 9/2008 | Yang | E05B 19/0005 109/47 |
| 8,695,388 | B2 * | 4/2014 | Miwa | E05B 19/0082 70/395 |
| 8,950,223 | B1 * | 2/2015 | Joyce | A45C 11/321 439/134 |
| 8,973,415 | B2 * | 3/2015 | Papaiz | E05B 19/0082 70/429 |
| 2004/0011100 | A1 * | 1/2004 | Ross | E05B 19/00 70/408 |
| 2006/0137413 | A1 | 6/2006 | Yu | |
| 2006/0150696 | A1 * | 7/2006 | Eychenne | A45C 11/325 70/456 R |
| 2007/0214851 | A1 * | 9/2007 | Yamaguchi | E05B 19/0082 70/396 |
| 2008/0115544 | A1 | 5/2008 | Yang | |

* cited by examiner

PADLOCK

TECHNICAL FIELD

The invention relates to a padlock.

PRIOR ART

Padlocks are widely used for locking different kinds of containers, storage units, boxes, hatches and other objects. A padlock comprises a body with a key-operated lock cylinder. Depending on the position of the lock cylinder, a latching member, or latching members, provided in the padlock secure the shackle (usually a U-shaped steel rod) to the body or allow the shackle to be moved relative the body, the object then being unlocked. WO 2013060942 discloses a known padlock, also having a protective cap to protect the keyhole.

Padlocks are commonly used for locking rarely visited remote facilities. Of course, other locking solutions than padlocks are used for such remote facilities as well. Besides, storage and other areas can include multiple locked objects, and, therefore, multiple separate locks. In this case, carrying keys can be problematic because the person heading to the storage area or the remote facility may lose the keys while he is carrying them, or, he may forget to take the keys with him. It is also possible that, he, on the way there, accidentally leaves the key or keys in his car, for example.

BRIEF DESCRIPTION OF THE INVENTION

The invention aims at alleviating the drawbacks related to the known art. The invention is based on an idea: that padlock comprises a key intended to unlock another lock. The other lock can be a padlock or some other locking structure. The key is inserted into a bore made in the body of the padlock, intended for one end of the shackle. To fit the key into the bore, its blade section is pivotable relative the shank of the key, and the blade section is adapted, in a first position of the blade section, to be at least partially received into the bore. The shank of the key can be received into the bore as well.

FIGURES

Figure 1:
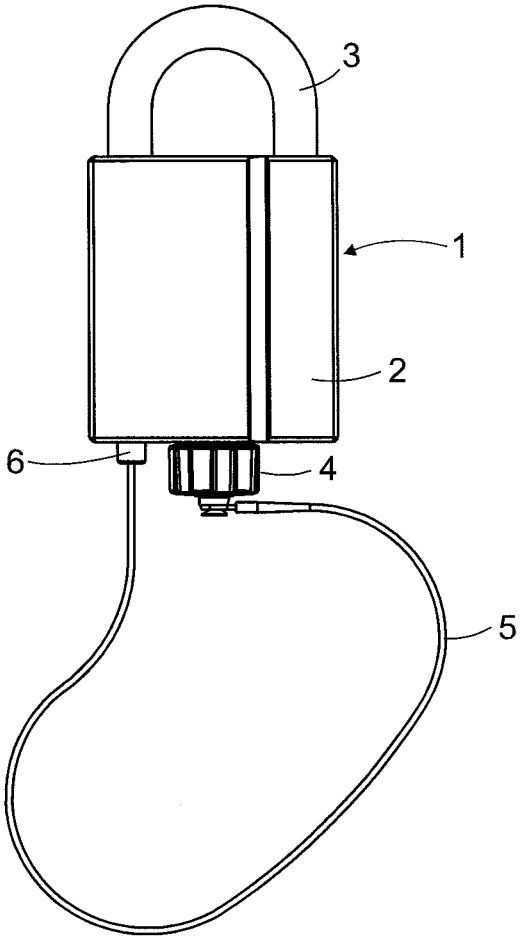
Figure 2:
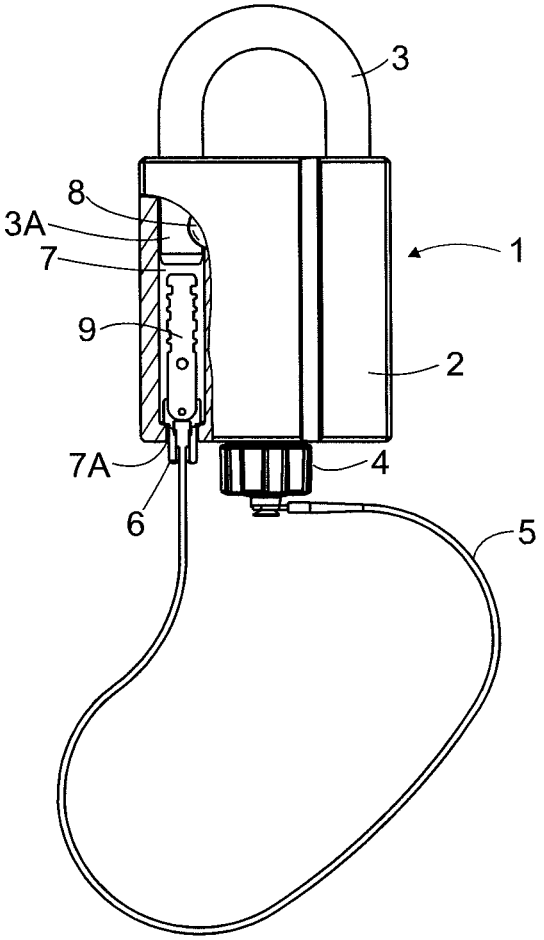
Figure 3:
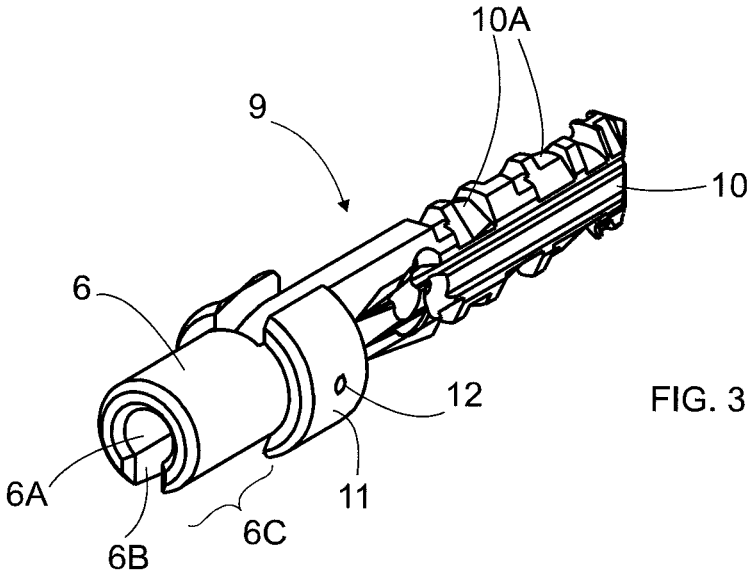
Figure 4:
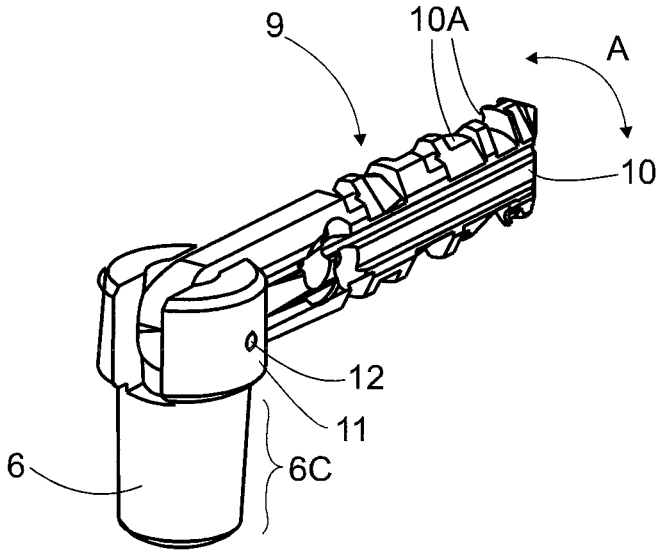
Figure 5:
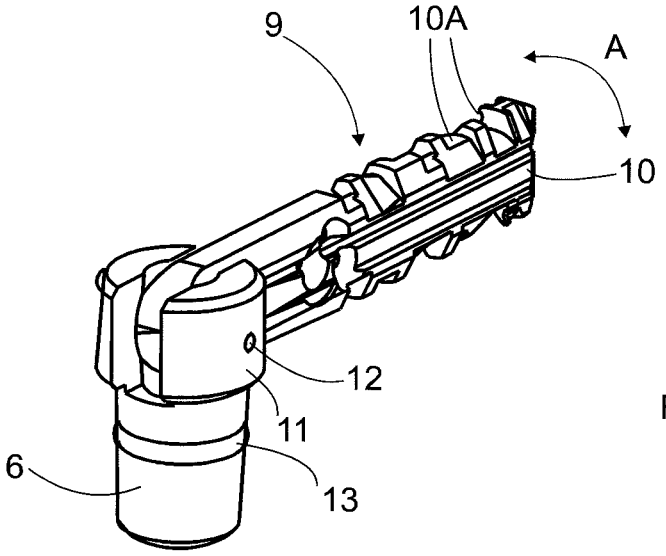
Figure 6:
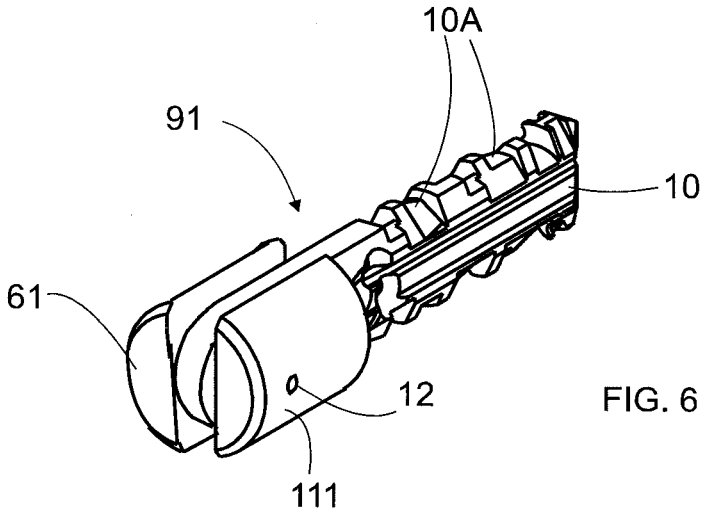

In the following, the invention will be described in more detail with reference to the following drawings wherein FIG. 1 shows an example of the padlock according to the invention, FIG. 2 is a section view of the example shown in FIG. 1, FIG. 3 shows an exemplary key insertable into the padlock, in a first position thereof, FIG. 4 shows the exemplary key insertable into the padlock, in a second position thereof, FIG. 5 shows another exemplary key insertable into the padlock, and FIG. 6 shows still another exemplary key insertable into the padlock.

DESCRIPTION OF THE INVENTION

FIG. 1 shows an example of the padlock of the invention. FIG. 2 is a section view of the padlock shown in FIG. 1.

The padlock 1 comprises a shackle 3 and a body 2. The body comprises bores 7 for both ends 3A of the shackle. The section view of FIG. 2 only shows one end 3A of the shackle, released out of the body by a latching member 8, able to move from a locking position to an unlocking position while the key is turned in the lock. As already mentioned above, it is known that the body also is provided with a lock cylinder and a second bore 7 (not shown in FIG. 2) for the other end of the shackle, analogously to WO 2013060942, for instance.

The padlock 1 according to the invention is provided with a key 9 intended to unlock another lock. The other lock can be a padlock, door lock or some other locking arrangement. The key is inserted into the bore 7 of the body receiving the shackle end 3A, which is removable out of the body 2 of the padlock. The removable end 3A is released out of the body in a known manner by using a key matching the lock cylinder of the padlock 1. Then, the key 9 can be taken out of the bore 7 to unlock another lock.

To fit the key into the bore, the key 9 comprises a blade section 6 pivotable relative the shank of the key. The blade section is adapted, in a first position of the blade section 6, to be at least partially received into the bore. It appears from the example of FIGS. 1 and 2 that a portion of the blade section is showing to the outside of the body 2 while the blade section is partially received into the bottom opening 7A of the bore 7. Many padlocks have a bore bottom opening to allow any water ended up in the bore to be drained away. FIGS. 3 and 4 show the key 9 in a first position and a second position of the blade section, respectively.

The blade section is, in its first position, substantially parallel to the shank 10 of the key 9. In this position, the key fits, at least partially, into the bore 7 of the body 2. It is not easy to manually turn the key in the first position. To allow the key to be turned with ease, the blade section 6 is pivotable to a second position, as shown in FIG. 4. The curved line A illustrates how the key 9 is turned to unlock another lock. The key 9 has been taken out of the bore 7 before pivoting the blade section 6 to the second position. As shown in the figures, the key 9 comprises a shaft 12 pivotably connecting the blade section 6 to the shank 10 of the key. In addition, the figures show combination cuts 10A on the shank of the key, forming an unlocking code on the key.

If a bottom opening 7A is provided at the bottom of the bore 7, the blade section 6 of the key comprises an expanded portion 11 not fitting into the bottom opening 7A of the bore 7. This prevents the key from falling out of the bore through the bottom opening while the padlock 1 is its locked position, with the end 3A of the shackle in the bore.

The blade section 6 of the key can comprise an end portion 6C fitting into the bottom opening 7A of the bore 7, as shown in the example of the figures. This allows the length of the blade section to be increased, making it easier to turn the key in the second position of the blade section. The end portion 6C of the blade section, which, while the blade section is its first position, is partially received into the bottom opening 7A of the bore of the padlock, can comprise a center hole 6A. In addition to the center hole 6A, the end portion 6C can comprise a lateral groove 6B extending from the surface of the end portion to the center hole 6A. The center hole 6A, or the combination of the center hole and the lateral groove 6B, can be utilized to fasten a wire 5 to the blade section 6 of the key. The first end of the wire 5 is fastened to the blade section 6 of the key. The second end of the wire comprises a portion whose size exceeds the diameter of the bottom opening of the bore. As an example, the second end of the wire can be fastened to a part larger in size than the diameter of the bottom opening 7A of the bore 7. The wire keeps the key 9 at the padlock 1. With the padlock in its unlocked position and the key 9 out of the bore 7, the padlock serves as a sort of keyring. As shown in FIGS. 1 and 2, the part larger in size than the diameter of the bottom opening 7A can be the body 2 of the padlock, or a protective cap 4 for the keyhole of the padlock, for instance.

FIGS. 5 and 6 show different embodiments of the key insertable into the bore of the padlock. The blade section 6 can comprise an elastic member 13 abutting the edge of the bottom opening 7A of the bore when the key is received into the bore. In this way, the key stays in place better. However, the blade section 6 can have other implementations than the ones shown in FIGS. 3 and 4. FIG. 6 shows an embodiment of the key 91 wherein the blade section 61 is, in its first position, pivoted up to face the combination cuts 10A of the key. An expanded portion 111 of the blade section not fitting into the bottom opening 7A of the bore 7 can be provided in this embodiment as well. The blade section 61 is pivotable down to a second position, in a similar way as shown in FIG. 4.

The padlock according to the invention provides the advantage that, for example, storage facility users do not have to carry keys for each single lock to be unlocked. That is, the padlock serves as both a lock and a key container. While the padlock is in its locked position, its body 2 and shackle 3 provide a good and unnoticeable shield of protection for key 7 received into the bore 7 of the body 2. A separate key container is not necessarily needed. In addition, the invention provides a convenient way of implementing locking solutions requiring the locks to be unlocked in a certain order. As an example, a storage facility can include a confined area accessible by unlocking a padlock according to the invention. After unlocking the padlock, the key 9 can be used to unlock another lock within the confined area. The invention also allows different kinds of security aspects to be addressed. As an example, two passageways can be adapted to be unlocked in a certain order. The right order is maintained by accessing the first passageway by unlocking a padlock according to the invention. The second passageway is unlocked with the key 9 that is taken out of the bore of the padlock 1.

In the light of the above examples, it is clear that there are many different solutions for creating an embodiment according to the invention. The blade section of the key received into the padlock can be implemented in several ways. The blade section of the key can penetrate the bottom opening of the bore. The padlock can be provided with a wire to keep the key at the padlock. That is, the padlock of the invention is not solely restricted to the above examples but can have many different embodiments within the scope of the independent claim.

The invention claimed is:

1. A padlock comprising:

a shackle; and a body, said body comprising bores for both ends of the shackle, wherein the padlock is provided with a key intended to unlock another lock, said key comprises a blade section pivotable relative a shank of the key, said blade section being adapted, in a first position of the blade section, to be at least partially received into one bore of said bores, wherein a bottom opening is provided at the bottom of said one bore, wherein the blade section of said key comprises an expanded portion that does not fit into the bottom opening of said one bore, and wherein said key is inserted into said one bore of the body receiving the shackle end, the shackle end being removable out of said body so that said key can be taken out of said one bore only when said shackle end is released out of said one bore.

2. The padlock as defined in claim 1, wherein the key comprises a shaft pivotably connecting the blade section to the shank of the key.

3. The padlock as defined in claim 1, wherein the blade section of the key comprises an end portion fitting into the bottom opening of said one bore.

4. The padlock as defined in claim 3, wherein the end portion of the blade section comprises a center hole.

5. The padlock as defined in claim 4, wherein the end portion of the blade section comprises a lateral groove extending from the surface of the end portion to the center hole.

6. The padlock as defined in claim 4, further comprising a wire whose first end is fastened to the blade section of the key and a second end of the wire is provided with a part larger in size than the diameter of the bottom opening of said one bore, respectively.

7. The padlock as defined in claim 6, wherein the part larger in size than the diameter of the bottom opening can be the body of the padlock, or a protective cap for the keyhole of the padlock.

* * * * *